United States Patent [19]

Rask et al.

[11] Patent Number: 4,974,912

[45] Date of Patent: Dec. 4, 1990

[54] POCKET DOOR SUSPENSION SYSTEM

[75] Inventors: Richard O. Rask, Whittier; Donald A. Kasten, Pomona, both of Calif.

[73] Assignee: Standard Precision, Inc., Santa Fe Springs, Calif.

[21] Appl. No.: 485,860

[22] Filed: Feb. 22, 1990

Related U.S. Application Data

[63] Continuation of Ser. No. 334,639, Apr. 5, 1989, abandoned, which is a continuation-in-part of Ser. No. 236,035, Aug. 24, 1988, abandoned.

[51] Int. Cl.[5] ..... E06B 00/00

[52] U.S. Cl. ..... 312/110; 312/322; 312/331; 49/254

[58] Field of Search ..... 312/309, 310, 322, 331; 49/254

[56] References Cited

U.S. PATENT DOCUMENTS

| | | | |
|---|---|---|---|
| 669,907 | 3/1901 | Wernicke . | |
| 865,114 | 9/1907 | Mates . | |
| 905,137 | 12/1908 | Benjamin . | |
| 972,412 | 10/1910 | Taussig . | |
| 1,472,457 | 10/1923 | Brown . | |
| 1,873,227 | 8/1932 | Abbott . | |
| 1,873,247 | 8/1932 | Abbott . | |
| 1,922,487 | 9/1933 | Meilink . | |
| 2,598,255 | 5/1952 | Hinkel . | |
| 2,652,305 | 9/1953 | Swedman . | |
| 2,667,400 | 1/1954 | Wotring | 312/331 |
| 2,669,499 | 2/1954 | Vanderplank . | |
| 2,723,177 | 11/1955 | Belew . | |
| 2,807,835 | 10/1957 | Weise . | |
| 2,936,206 | 5/1960 | Wilmer . | |
| 3,017,233 | 1/1962 | Gates . | |
| 3,339,995 | 9/1967 | Bencene . | |
| 3,456,995 | 6/1969 | Nyquist . | |
| 3,722,964 | 3/1973 | Chitester | 312/331 |
| 4,729,612 | 3/1988 | Stone | 312/110 |

FOREIGN PATENT DOCUMENTS 1143415 2/1958 Fed. Rep. of Germany .

*Primary Examiner*—Kenneth J. Dorner
*Assistant Examiner*—Gerald A. Anderson
*Attorney, Agent, or Firm*—James E. Hawes; L. Harmon Hook

[57] ABSTRACT

A pocket door suspension system which permits the door to be moved, without skewing or sagging, from a closed position to an open and retracted position adjacent a supporting wall, the system having two telescoping slide assemblies mounted to the supporting wall, the door being attached by hinges to moveable members of the slide assemblies. Two cables are provided, each attached at one end to the back end of one fixed slide member and at the other end to the front end of the other fixed slide member. Each cable is slideably attached to the moveable members of the slide assemblies such that the pair of cables trace an "I" figure, the pair of cables effectively preventing the moveable members of the slide assemblies from moving out of a predetermined relationship to each other.

11 Claims, 3 Drawing Sheets

POCKET DOOR SUSPENSION SYSTEM

This is a continuation of co-pending application Ser. No. 07/334639 filed on Apr. 5, 1989, now abandoned, which is a continuation-in-part of Ser. No. 236,035, filed Aug. 24, 1988, now abandoned.

The present invention relates to a pocket panel suspension system, such as a suspension system for a door movable between a first or closed position in which it is adjacent to the corner of a wall panel, and perpendicular to that wall, and a second or open position in which it is parallel to the wall and retracted to lie alongside and to overlie the face of the wall.

Many pocket door suspension systems have been devised. All incorporate hinges mounted to permit the door edge to slide relative to the supporting wall. Because of this, the weight of the door will tend to cause the bottom hinge to move relative to the top hinge in a direction such that the center of the gravity of the door would be under the top hinge. This tendency causes the door to sag or skew from its normal vertical hinge axis, and to tilt the door from a square relationship to the hinges, slides, and side wall.

Early pocket door suspension systems counteracted the tendency of the door to sag or skew relative (to the slides' traverse axis) by employing, for example, a series of rollers to support the bottom edge of the door as it moves into and out of the pocket. Other earlier systems employed increasingly heavier hinges and telescoping slides, the resulting strength of these members being intended to resist the tendency of the door to sag or skew. Some more recent systems have employed chains or cables to transmit to the top hinge the force tending to skew the bottom hinge, to hold the hinges over one another and to maintain the door square to the hinges, slides, and side wall. One example of such a cabling arrangement is shown in German Patent No. 1,143,415 to Ziehl; another example of such a cabling system is shown in Stone U.S. Pat. No. 4,729,612. Such cabling arrangements fix the ends of the cable to the top and bottom hinge plates, and provide pulleys, one at the rear end of the top slide and the other at the front end of the bottom slide, so that the cable traces a "Z" pattern on the side wall. Thus, as the door is moved, for example, towards a retracted position, the force tending to move the bottom hinge plate further into the pocket or cabinet is transmitted by the cable directly to the top hinge plate, to hold the top hinge plate over the bottom hinge plate.

There are two different and distinct forces which tend to cause a pocket panel or door to sag or skew relative to the side wall. One of these forces has been described. It is the force of gravity which tends to torque the bottom hinge relative to the top hinge such that the center of gravity of the door would be under the top hinge. The other force is the manual force applied to move the door, which force can tend to lift the door and move the top hinge, for example, further into the pocket than the bottom hinge. To hold a door square to its attached cabinet or side wall, it is necessary to prevent skewing resulting from both of these forces, not just the force of gravity. However, prior pocket door suspension systems, especially those which are relatively economical in construction and easy to install, have only addressed the first force, the force of gravity.

One object of the present invention is to provide a pocket door suspension system which is simple in construction, easy to install, and which counteracts all significant forces tending to skew the door, thereby to ensure that the door remains in a square relationship to the slides and side wall. Another object of the present invention is to provide such a system which is simple to install and easy to adjust.

These and further objects of the invention will be apparent from the following description of a preferred embodiment.

BRIEF SUMMARY OF THE INVENTION

The pocket door suspension system of the present invention is designed, in its preferred embodiment, to be used with a door or other panel which is movable between a closed position in which the door is adjacent a corner defined by two walls, or at the end of a supporting wall, and is perpendicular to that supporting wall, and an open or retracted position in which the door has been turned to lie parallel to the supporting wall and moved to a position in which it overlies the supporting wall, preferably with the front edge portion of the door lying adjacent to the end of the supporting wall.

The suspension system of the present invention holds such a pocket door square to the supporting wall as it moves between its closed position and its open, retracted position. The system includes at least two telescoping slide assemblies, one portion of each assembly being attached to the supporting wall, normally perpendicular to the pivoting edge of the door. These slide assemblies are spaced relative to one another, and are fixed to the supporting wall such that they are substantially parallel to one another and lie substantially in the same plane. The door is attached to the slide assemblies by hinges, one leaf of each hinge being attached to the door and the other leaf of each hinge being attached to the movable, telescoping portion of the slide assembly substantially in the plane defined by slide assemblies, thereby to permit the door to pivot between a position perpendicular to the slide assembly and parallel to the slide assembly.

The present invention holds the door square to the slides and supporting wall by employing cable elements. One end of each cable element is fixed adjacent to the rear end of the fixed portion of one slide assembly, the other end of the cable being fixed adjacent the front end of the fixed portion of the other side assembly.

In one embodiment, the cable elements are separate; in another embodiment, the same cable provides both cable elements.

A pair of double pulley assemblies are also employed, a pulley being fixed to the movable portion of each slide assembly preferably adjacent the hinge leaf. Each cable element (of the pair cables) is positioned to pass over each pulley assembly such that the cable elements trace an "I" figure and lie substantially in the plane defined by the slide assemblies. Thus, as the door moves between its closed and open positions, the cable elements cooperate with the pulleys to hold the sliding portions of the telescoping slide assemblies in a fixed, square relationship to one another against canting forces resulting from both the force of gravity upon the door as well as from any lift which may be applied to the door as it is being moved.

In the preferred embodiment, preferably a channel is attached to the sliding portions of the slide assemblies to fix and hold the hinges relative to one another, and to envelope and shield the portions of the (moving) cable elements extending between the slide assemblies as the door moves between its closed and open positions. Also, preferably guide rollers are employed to require the door to be first moved from a position perpendicular to the supporting wall to a position parallel to the supporting wall before the door is moved back into its pocket to overlap the supporting wall, and to hold the door alongside the supporting wall when it is in a partially or fully retracted position. Further, preferably the cable elements are part of a single cable for ease of assembly and adjustment.

These and other features of the present invention are described in the following sections, and are set forth in one or more of the claims.

BRIEF DESCRIPTION OF THE DRAWINGS

The invention will be further described in connection with the accompanying drawings in which.

DESCRIPTION OF A PREFERRED EMBODIMENT

The pocket door suspension system of the present invention is shown and described in connection with a cabinet or closet structure having doors hinged to be moveable about a vertical axis. It could, of course, be applied to most any other type of pocket door or panel, such as one in which the door is hinged about a horizontal axis, or is movable about an axis located in most any other orientation. Thus, the following detailed description of a preferred embodiment should not be construed to limit the generality or broad usefulness of the present pocket door suspension system.

Figure 1:
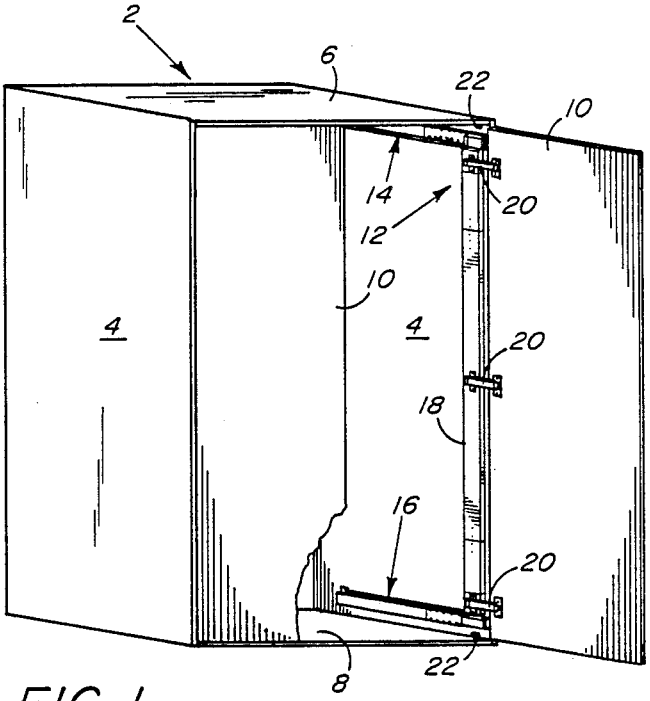
FIG. 1 is a perspective view of a cabinet or closet showing one door in a closed position and another door in an open position ready to be moved back into the cabinet.
Figure 2:
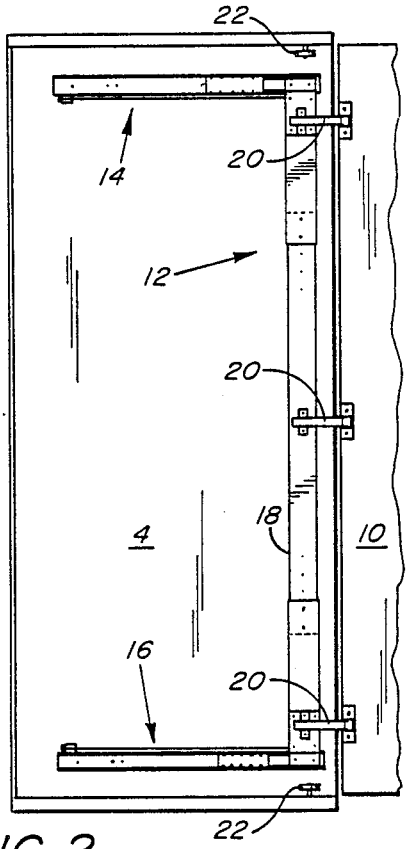
FIG. 2 is an elevational view of a door, broken to show only its hinged edge portion, and one arrangement of the suspension system of the present invention mounted on a supporting wall.

As shown in FIG. 1, the suspension system maybe incorporated in a closet or cabinet 2 having side walls 4, a top wall 6, a bottom wall 8, and doors 10. Each door is attached to an adjacent side wall by a suspension system 12 having a top telescoping slide assembly 14, a bottom telescoping slide assembly 16, and a follower channel or bracket 18. Hinges 20, each being preferably a toggle type or European style hinge, such as a Mepla hinge, attach the edge portion of door 10 to the slide plate 40. Auxiliary pivot rollers 22 are mounted to the top and bottom walls of the cabinet, tangent to the rear door face, to require each door to be fully opened to a position generally parallel to its side wall before the door can be moved back into the cabinet, the top and bottom edge portions of the door rolling against the pivot rollers 22 as the doors are moved into and out of the cabinet. Preferably each slide assembly is an Accuride slide, available from Accuride, 12311 Shoemaker Avenue, Santa Fe Springs, Calif. 90670. These slide assemblies preferably are mounted to the side wall at a spacing from one another which is a multiple of 32 millimeters, consistent with the 32 millimeter European system of cabinetry construction. Of course, various other types of slides, and mounting hardware, could be employed, the particular selection being largely determined by the preference of the user.

Figure 3:
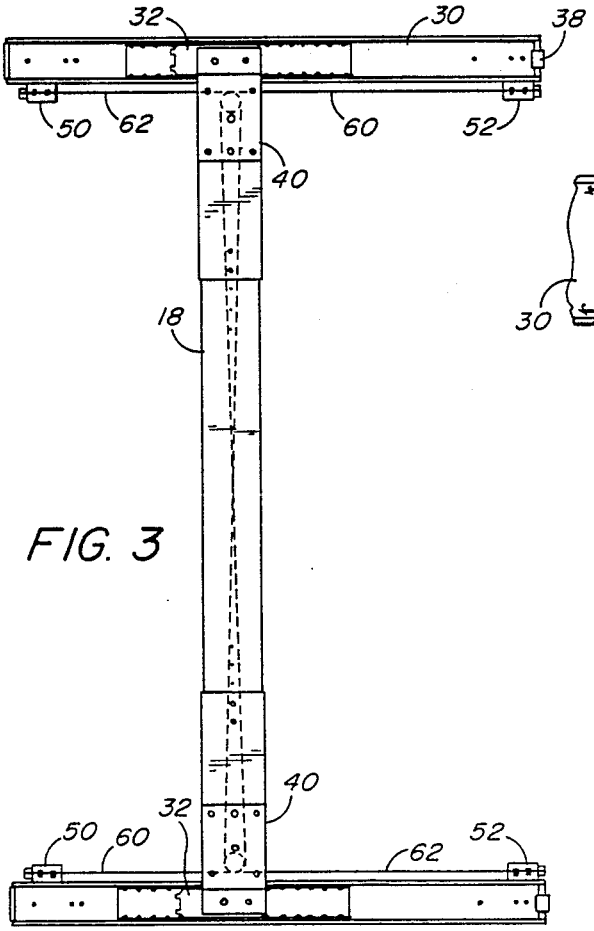
FIG. 3 is an elevational view of one arrangement of the suspension system of the present invention, but without any hinges attached thereto.

As shown in our preferred embodiment in FIG. 3, each slide assembly consists of a channel 30 fixed to the supporting side wall by appropriate fasteners. A slide member 32 is received within the channel 30 and held spaced from the concave, opposed sides of the channels by a series of ball bearings 34 (best shown in FIG. 4). A ball retainer 36 (see FIG. 5) holds balls 34 within the slide assembly and in a predetermined relationship to one another. Thus, as the slide member 32 moves relative to the fixed member 30 from one end to the other end, it rolls along bearings 34. Appropriate bumpers or stops 38 are provided at the front and back ends of the fixed member 30 to prevent the slide member from moving out of its telescoping relationship to the fixed member.

Figure 4:
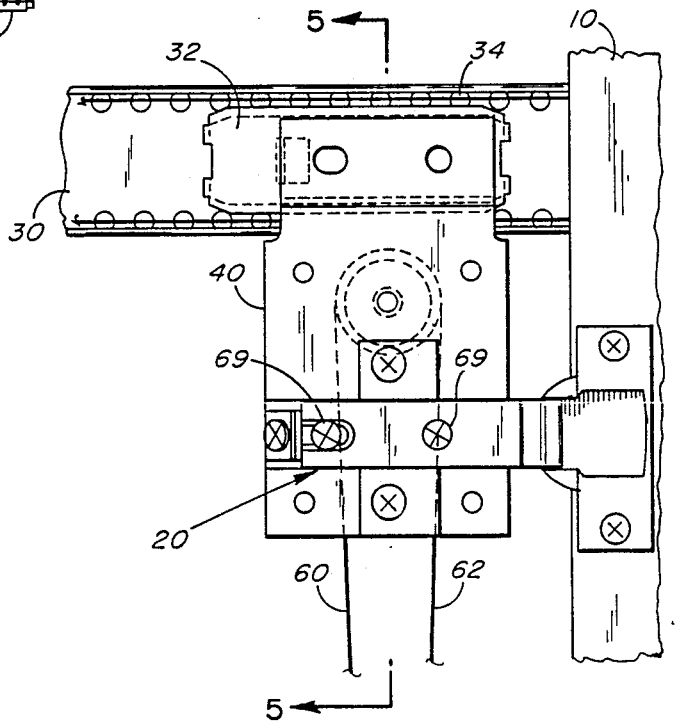
FIG. 4 is an elevational view of a portion of the suspension system of the present invention showing the edge portion of a door hinged to the slide plate attached to the slideable member of a telescoping slide assembly, only a portion of the slide assembly being shown.
Figure 5:
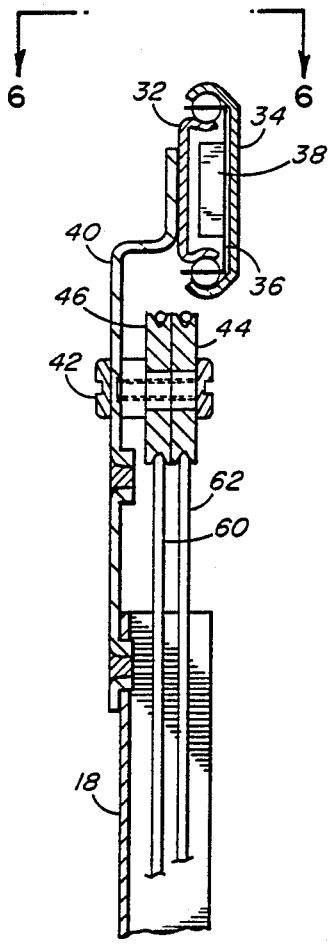
FIG. 5 is a view in cross section taken on lines 5—5 of FIG. 4.

As shown best in FIGS. 4 and 5, a slide plate 40 is attached to each slide member 32, preferably by welding. It receives and supports a pulley stud 42 about which is mounted a pair of pulleys 44 and 46, preferrably formed of delrin.

Figure 7:
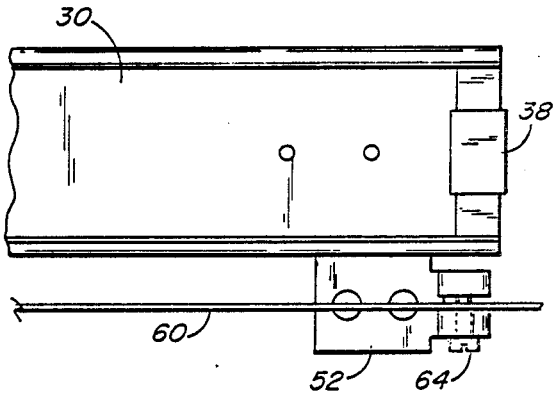
FIG. 7 is an elevational view of one construction of the front fixed portion of the upper telescoping slide assembly.
Figure 8:
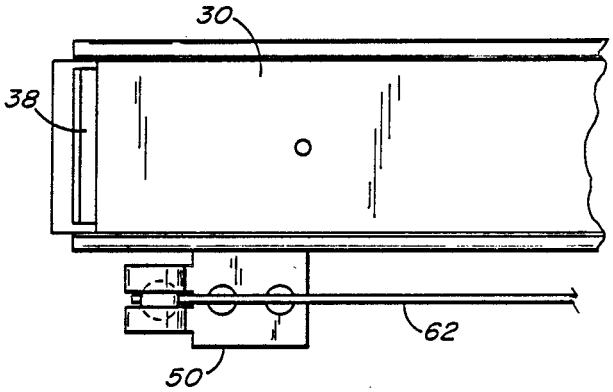
FIG. 8 an elevational view of one construction of the rear fixed portion of the upper slide assembly.
Figure 6:
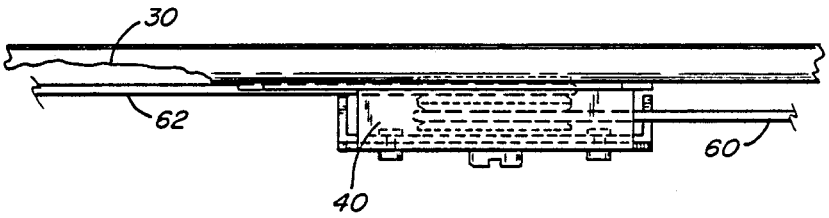
FIG. 6 is a top view of the slide assembly shown in FIG. 4, but without the door and its hinge being attached thereto.

A cable holder ball bracket 50 (see FIG. 8) is attached adjacent to each fixed slide assembly member near its rear end, and a cable holder wire clamp bracket 52 (see FIG. 7) is attached adjacent to each fixed member 30 near its front end. A pair of cable elements 60 and 62 are attached between these cable holder brackets, one end of each cable element having a ball swaged thereto and being received in one of cable holder ball brackets 50, the midportion of the cable element passing over pulley 44 and then extending to the opposite slide plate 40 where it passes over pulley 46 and is clamped to cable holder wire clamp bracket 52 by a set screw 64 shown in FIG. 7. During installation preferably the tension on each cable element is adjusted to be a few pounds, then set screw 64 (see FIG. 7) retightened to clamp and hold this tension on the cable. Any equivalent means of fixing each cable element end under tension may be employed, if desired.

The follower bracket 18 preferably is shaped as a channel to receive and partially envelop the midportions of cable elements 60 and 62 extending between the pulley assemblies on the opposed slide plates 40. As can be seen most clearly in FIG. 3, by virtue of this construction cables 60 and 62 trace an "I" pattern.

As shown most clearly in FIG. 5, the two cable elements pass over two pulleys 44 and 46 mounted on a single stud 42. Thus, one cable is spaced further from slide plate 40 than the other. Preferably these cables are threaded over the pulleys such that the cable extending to clamp bracket 52 is closest to slide plate 40, and the cable extending to ball bracket 50 passes over the pulley furthest from slide plate 40. In other words, the two cables as they pass one another in follower channel 18 cross over. By this arrangement, the cable holder ball bracker 50 receives the end portion of a cable at an elevation spaced further from slide plate 40 than the elevation of the slot in clamp bracket 52 through which the cable passes to be clamped by set screw 64.

Because the center of gravity of door 10 is spaced substantially away from the pivoting axes of hinges 20, a torque will be exerted on the hinges and the structure to which they are attached. This torque tends to pivot the door, by virtue of its weight, so that its center of gravity would be under the top-most hinge 20. In addition, as the door is being moved manually, an upward force may be exerted on it tending to move the door to pivot about the lowermost hinge 20. The suspension system of the present invention counteracts both of these forces in a simple yet effective fashion. More specifically (and with reference to FIG. 3) the torque resulting from the force of gravity on the door will tend to move the lower slide plate 40 towards the rear end of the bottom slide assembly and its cable holder bracket 50. This force is transmitted by the lower pulley assembly to cable element 62, and by this cable element to the upper slide plate 40 and its attached pulley assembly, then to cable holder bracket 50 at the rear end of the top slide assembly. Because of this arrangement, cable element 62 and its associated structure will effectively prevent the lower slide plate 40 from moving out of a square relationship to the slide assemblies and to upper slide plate 40. Similarly, any upward force exerted upon the door will tend to cause upper slide plate 40 to move towards cable holder 50 and lower slide plate 40 to move towards cable holder 52. These forces are counteracted by cable element 60, the force exerted on upper slide plate 40 being transmitted to this cable element by its attached pulley assembly, and by the cable element to the pulley assembly attached to lower slide plate 40 and then to the rear cable holder bracket 50 attached adjacent to the lower telescoping slide assembly 30. Thus, cable elements 60 and 62 will hold the door square to slide assemblies 14 and 16.

Mounting a pocket door using the suspension system of the present invention can be accomplished quickly and simply. First, the telescoping slide assemblies are attached to the side wall in a parallel relationship with their front ends just behind the desired back plane of the door. As has been noted previously, preferably the two slide assemblies are spaced from one another a distance which is a multiple of 32 millimeters. Next, pulleys 44 and 46 are attached to the movable portions of the telescoping slide assemblies, and cables 60 and 62 loosely threaded from one cable holder 50 to an opposed cable holder 52, then follower bracket 18 is attached to the slide plates. The cable elements are each pulled to equalize their tension (a few pounds of tension normally is sufficient) and to square follower bracket 18 to the slide assemblies; each cable element is clamped to cable hold bracket 52 by tightening set screw 64. The edge portion of the pocket door to be mounted is drilled to receive one leaf of the toggle hinge 20, and the base plate of the toggle hinge is attached to the slide plate 40 (or follower bracket 18). Then the other leaf of the toggle hinge is received onto the base plate, and attached to the base plate which is already fastened to plate 40 by screws 69 (see FIG. 4), to attach the door to the suspension system. Then the suspension system and door is moved to its forward position and the door adjusted, by loosening and tightening the screws attaching the toggle hinge to its base plate, to position the edge of the door at the desired location relative to the edge of the side wall 4. This completes the assembly and installation. Should the pocket door ever require readjustment, it can easily be effected by the process just described.

The doors 10 may be mounted by the present suspension system in an overlapped or non-overlapped relationship to cabinet 2. They are shown in FIG. 1 in a non-overlapped position. Were they instead in an overlapped position, the edge portions of the doors to which hinges 20 are attached would overlie the front edges of walls 4.

At times it is difficult to access the front cable holder bracket 52 since it is easily blocked by the door. In addition, the embodiment of the suspension system just described requires each cable element to be separately adjusted, which gives rise to the possibility that one cable element will have a significantly different tension than the other cable element.

Figure 9:
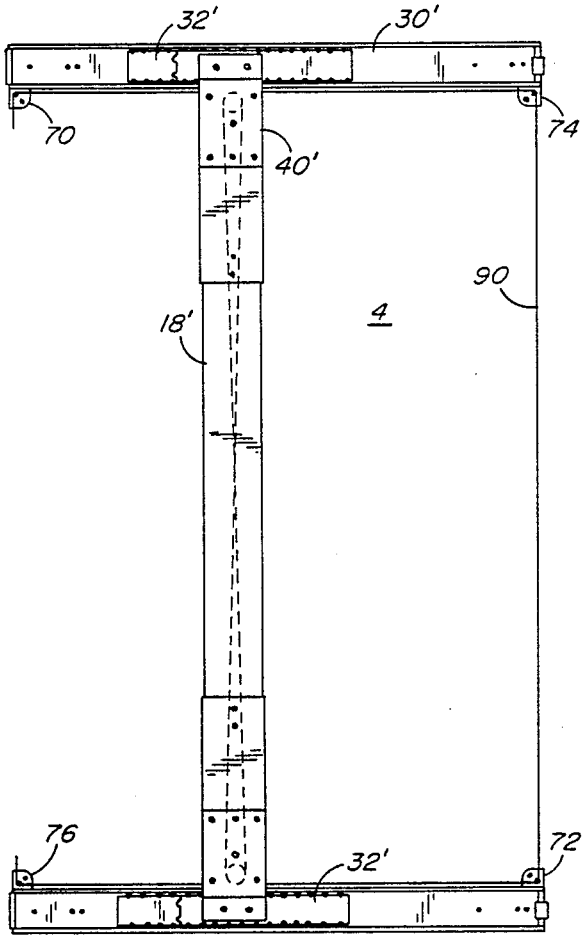
FIG. 9 is an elevational view similar to FIG. 3 of a second arrangement of the suspension system of the present invention.
Figure 10:
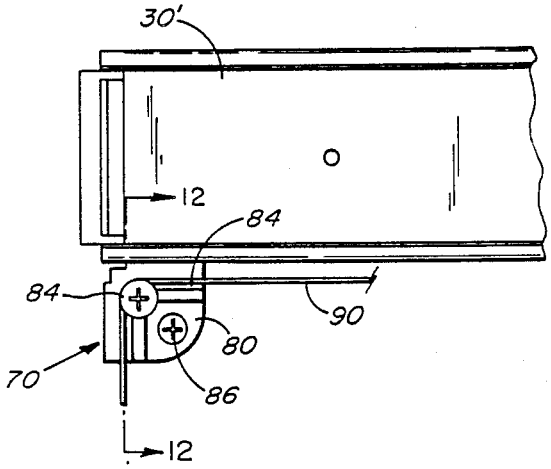
FIG. 10 is an elevational view of the rear fixed portion of the upper slide assembly shown in FIG. 9.
Figure 11:
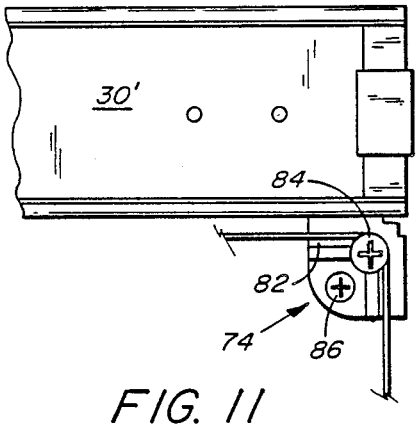
FIG. 11 is an elevational view of the front fixed portion of the upper telescoping slide assembly shown in FIG. 9.
Figure 12:
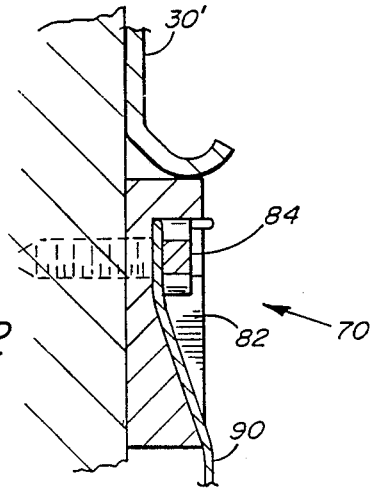
FIG. 12 is a cross-sectional view of the rear fixed portion of the upper slide assembly as seen through section lines 12—12 of FIG. 10.

Shown in FIGS. 9 through 11 is an alternate embodiment of the pocket door suspension system in which the cable elements are portions of a single cable, and pass through brackets of a somewhat different construction than brackets 50 and 52. Thus, in this alternative embodiment the cable, instead of tracing an "I" pattern, traces a pattern defining a "A" lying on its side. The cable extends from one clamp bracket 70 at the innermost end of one slide, over the pulley assembly then through channel member 18', over the pulley assembly at the other end of the channel then to clamp bracket 72 (which is identical to clamp bracket 70), then to clamp bracket 74, then again over the pulley assemblies and through the channel member 18' to terminate in clamp bracket 76. The clamp brackets are all essentially identical in construction. That construction is shown in FIGS. 10–12. The clamp bracket consists of a block 80 having an arcuous channel 82 defined in its front face to receive a portion of the cable, and incorporating two openings for screws 84 and 86. To mount these clamp brackets, the other elements of the slide assembly are first mounted to side walls 4, then the clamp brackets are positioned at the end/s of each slide, as shown in FIG. 9. Screw 86 is employed to attach the bracket to the panel, the bracket snugly bearing upon the adjacent face of the channel 30'. After a cable 90 has been threaded through the brackets and over the pulleys as previously described, screws 84 are inserted in each clamp bracket and used to loosely clamp and hold the cable 90 in place. Then the door or other panel number with its hinges is mounted on channel 18'.

To adjust the door to obtain a plumb or vertical relationship, it is simply necessary to loosen a screw 84 at clamp bracket 76 and draw a slight tension on cable 90. This will tend to skew channel member 18 somewhat. However, the tension extends through this section of the cable to at least clamp block 74. Next, the screws 84 in clamp blocks 70 and 72 are loosened and the cable end of clamp block 70 drawn through the block sufficiently to increase the tension in this portion of the cable to pull channel member 18' with its supported door into a truly plumb or vertical relationship. Then screws 84 in all clamp blocks 70–76 are tightened as best depicted in FIG. 12. This holds the crossing cables, and the slide assembly, in the desired relationship to ensure that the door will remain plumb throughout its use. The door may also be plumbed by first applying a few pounds of tension to the cable and tightening clamp blocks 70 and 76, then moving slide plates 40' and channel member 18' with the attached door to skid this assembly relative to the cables until the door is in the desired plumbed relation, then finally tightening clamp blocks 72 and 74. Thus, the embodiment of the slide assembly shown in FIGS. 9 through 11 is somewhat easier to install and adjust than the embodiment shown in FIGS. 3 through 8.

Since modifications and elaborations of the present invention will be apparent to those skilled in this art, the scope of the invention is not limited to the preferred embodiment shown and described but instead is set forth in the following claims.

We claim:

1. A pocket door suspension system to permit a door to be moved relative to a supporting wall between a closed position in which it is substantially perpendicular to the supporting wall, and an open retracted position in which it is substantially parallel to and alongside the supporting wall, the system holding the door square to the supporting wall as it moves between said open and closed positions, the system including at least two telescoping slide assemblies, one portion of each assembly being attached to the supporting wall, said attached portions of said slide assemblies being spaced apart and parallel to each other, and at least two hinge means, one leaf of each of said hinge means being attached to a corresponding one of the movable, telescoping slide assemblies and the other leaf of each of said hinge means being attached to the pivoting edge portion of the door to permit the door to pivot between a closed position in which it is angled relative to the supporting wall and an open position in which it is parallel to the supporting wall, the slide assemblies allowing the door to slide relative to the supporting wall, the improvement comprising:

a cable element, means holding one end of the cable element in a fixed relationship relative to a first end of the attached portion of one slide assembly, means holding the other end of the cable element in a fixed relationship relative to a first end of the attached portion of the other slide assembly, a pair of guide elements, each guide element being fixed near a second end of the fixed portion of a corresponding one of said slide assemblies, at least two pulley assemblies, each pulley assembly being fixed near a corresponding one of said hinge means, the mid-portions of each cable passing over each pulley assembly then over a guide element at the second ends of the slide assemblies such that the pair of cables traces a sideways "A" figure, whereby as the door moves between its closed position and its open, retracted position the pulley assemblies and the hinge means roll along the cable element, the cable element substantially preventing the door from skewing or sagging out of a predetermined relationship to the fixed portions of the slide assemblies and the supporting wall.

2. A pocket door suspension system as set forth in claim 1 in which each hinge means is attached to the end portion of the movable, telescoping portion of a slide assembly adjacent the edge of the door.

3. A pocket door suspension system as set forth in claim 1 in which the means to hold the cable is adjustable to the tension in the cables to be adjusted.

4. A pocket door suspension system as set forth in claim 1 including guide means to permit the door to only be moved along the side wall after it has been moved from a position angled to the side wall to a position parallel to the side wall, and to hold the door alongside the side wall when it is in either a partially or fully retracted position.

5. A pocket door suspension system as set forth in claim 1 in which the hinge means permits the door to be mounted so that one side edge of the door abuts and is perpendicular to the front edge portion of the side wall, the front face of the door lying on the plane of the front edge of the side wall.

6. A pocket door suspension system as set forth in claim 1 in which the guide elements at said second ends of the slide assemblies are adjustable to hold the cable element in a fixed relationship relative to said second ends of the slide assemblies.

7. A pocket door suspension system as set forth in claim 1 in which each of said pulley assemblies includes a pair of pulleys, one for each cable, the pulleys being attached to the movable portion of said slide assembly means by a common stud axle.

8. A pocket door suspension system as set forth in claim 1 including means to permit the tension in said cable element to be adjusted after the door has been mounted to the suspension system.

9. A pocket door suspension system as set forth in claim 1 including means to limit travel of the movable member relative to the fixed member of each slide assembly.

10. A pocket door suspension system to permit a door to be moved relative to a supporting wall between a closed position in which it is substantially perpendicular to the supporting wall, and an open retracted position in which it is substantially parallel to and alongside the supporting wall, the system holding the door square to the supporting wall as it moves between said open and closed positions, the system including at least two telescoping slide assemblies, one portion of each assembly being attached to the supporting wall, said attached portions of said slide assemblies being spaced apart and parallel to each other, and at least two hinge means, one leaf of each of said hinge means being attached to a corresponding one of the movable, telescoping slide assemblies and the other leaf of each of said hinge means being attached to the pivoting edge portion of the door to permit the door to pivot between a closed position in which it is angled relative to the supporting wall and an open position in which it is parallel to the supporting wall, the slide assemblies allowing the door to slide relative to the supporting wall, the improvement comprising:

a pair of cable elements, one end of each cable element being in a fixed relationship relative to the rear end of the attached portion of one slide assembly, the other end of each cable element being in a fixed relationship relative to the front end of the attached portion of the other slide assembly, and at least two pulley assemblies, each pulley assembly being fixed near one of the hinge means, the mid-portions of each cable passing over each pulley assembly such that the pair of cables traces an "I" figure, each movable portion of each slide assembly including a hinge plate to which one of said hinge means is attached, and channel means attaching the hinge plates to one another in a fixed relationship whereby as the door moves between its closed position and its open, retracted position the pulley assemblies and the hinge means roll along the pair of cables, the cables substantially preventing the hinges from skewing or sagging out of a predetermined relationship to the fixed portions of the slide assemblies and the supporting wall.

11. A pocket door suspension system as set forth in claim 10 including at least three hinge means, two of said hinge means being attached to said hinge plates, the third hinge means being attached to the edge portion of the door and to said channel means.

* * * * *